US005851077A

United States Patent [19]

Trejo

[11] Patent Number: 5,851,077

[45] Date of Patent: Dec. 22, 1998

[54] INDUSTRIAL GRADE SUNSCREEN LOTION APPLICATOR APPARATUS AND METHOD OF SELF-USE ON A BACKSIDE

[76] Inventor: Pamela L. Trejo, 5050 N. La Cholla #47, Tucson, Ariz. 85705

[21] Appl. No.: 740,876

[22] Filed: Nov. 4, 1996

[51] Int. Cl.[6] ..... A45D 34/00; A45D 34/04

[52] U.S. Cl. ..... 401/6; 401/140; 401/202; 401/205; 401/213; 401/219

[58] Field of Search ..... 401/202, 213, 401/6, 205, 262, 219, 281, 140

[56] References Cited

U.S. PATENT DOCUMENTS

| | | | |
|---|---|---|---|
| D. 265,255 | 6/1982 | O'Neill | D28/7 |
| D. 306,214 | 2/1990 | Delphus | D28/7 |
| D. 307,490 | 4/1990 | Thieroff, Jr. et al. | D28/7 |
| D. 308,733 | 6/1990 | Damians | D28/7 |
| D. 333,191 | 2/1993 | Rainen | D28/7 |
| D. 341,222 | 11/1993 | Corrigan | D28/7 |
| D. 346,041 | 4/1994 | Trinkaus | 401/6 X |
| D. 353,223 | 12/1994 | Moore | D28/7 |
| 1,112,193 | 9/1914 | Carleton et al. | 401/205 X |
| 2,736,913 | 3/1956 | Mirth | 401/6 X |
| 2,800,673 | 7/1957 | Lazisky | 15/118 |
| 4,090,647 | 5/1978 | Dunning | 401/262 X |
| 4,171,171 | 10/1979 | Jones | 401/6 X |
| 4,299,005 | 11/1981 | Brown | 15/244 |
| 4,486,636 | 12/1984 | Meyer | 401/6 X |
| 4,571,106 | 2/1986 | Scuderi | 401/6 X |
| 4,896,984 | 1/1990 | Evans | 401/140 |
| 4,961,661 | 10/1990 | Sutton et al. | 401/6 |
| 5,240,339 | 8/1993 | DeForest et al. | 401/207 |
| 5,360,111 | 11/1994 | Arispe | 206/361 |

FOREIGN PATENT DOCUMENTS

| | | | |
|---|---|---|---|
| 682041 | 7/1993 | Switzerland | 401/6 |

*Primary Examiner*—Steven A. Bratlie

*Attorney, Agent, or Firm*—LaRiviere, Grubman & Payne, LLP

[57] ABSTRACT

A sunscreen lotion applicator for use by shirtless construction workers that includes a rugged construction, lotion-container, tubular handle and a flexible, necked applicator head. The lotion-container handle is contoured for facilitating not only access to a person's backside for lotion application, but also for being carried on a tool belt by a construction worker, in a similar manner as other tools, such as hammers and wrenches. The handle includes a detachable fill cap having a rough texture for better on/off manipulation, upper rough textured grip that facilitate firm grasping for insertion and removal from a tool belt and a lower rough texture grip for firm grasping during its use. The handle also includes an elongated window for viewing the lotion content in the handle. The applicator head member is constructed in the form of a ball roll-on applicator, or alternatively as a cylindrical roller, or as a replaceable porous dauber that is covered with a chained cap. The applicator head connects with the lotion-container handle via a bellows portion that facilitates flexible manipulation, and adjustment capability while being worn on a tool belt. The head member includes a first chamber region in fluid communication with the main, lotion container handle body and a second dispensing chamber region in communication with the applicator ball, roller, or porous dabber, as provided. The two chambers are separated by an open/close mechanism which controls the flow of different viscosities of lotions into the dispensing chamber.

16 Claims, 3 Drawing Sheets

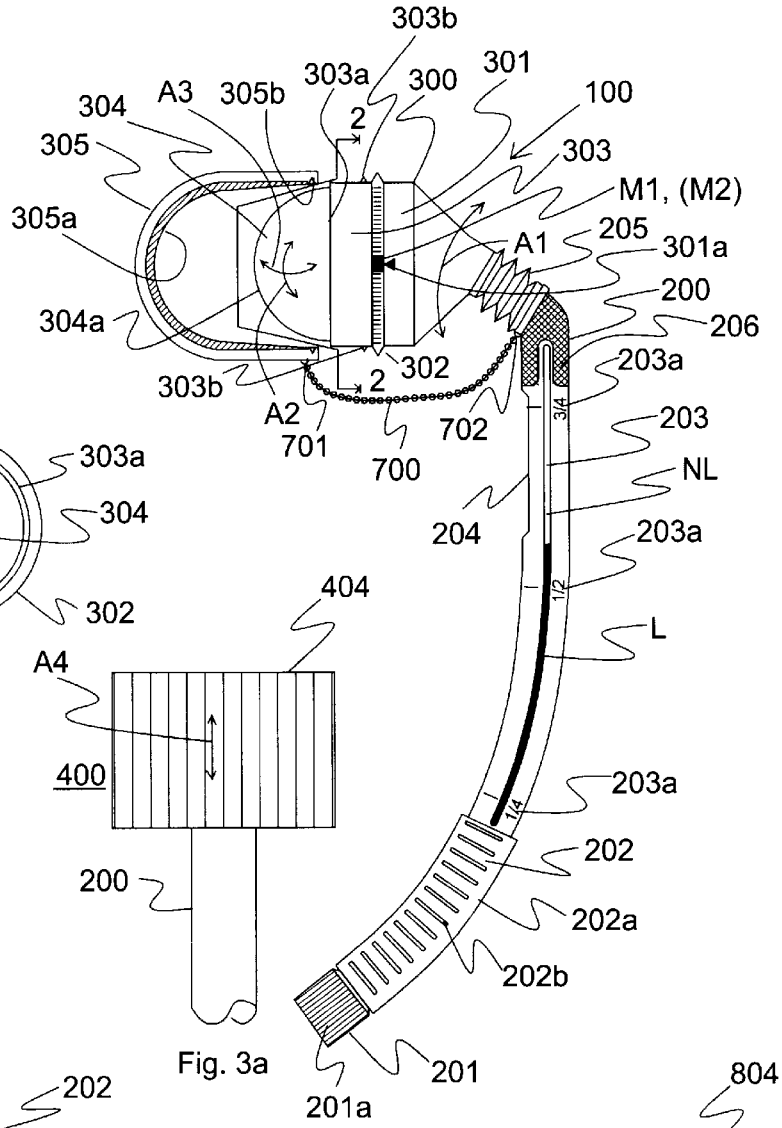
Fig. 1
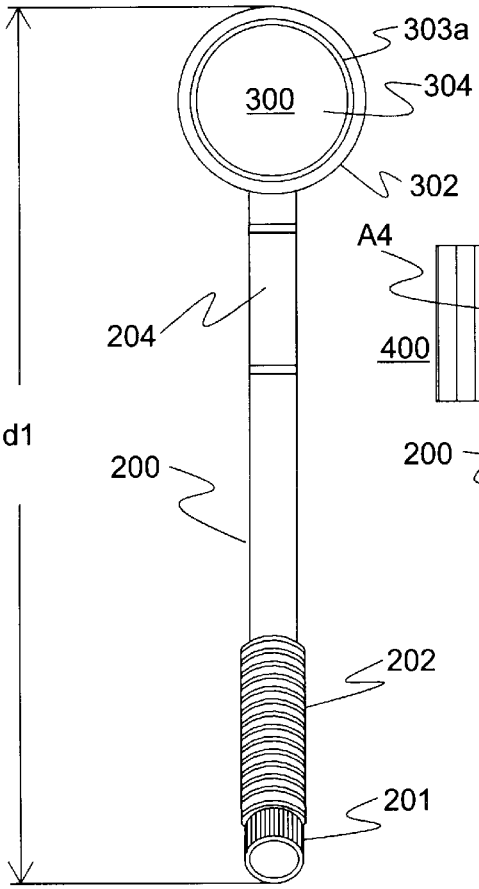
Fig. 2
Fig. 3a
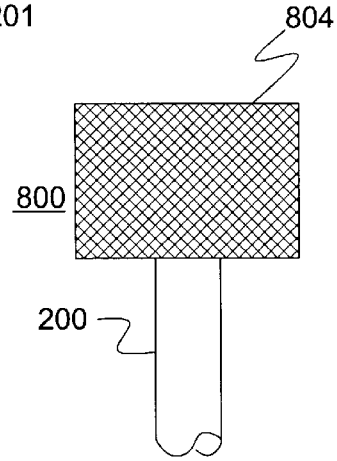
Fig. 3b

INDUSTRIAL GRADE SUNSCREEN LOTION APPLICATOR APPARATUS AND METHOD OF SELF-USE ON A BACKSIDE

FIELD OF THE INVENTION

The present invention relates to lotion applicators. More particularly, the present invention relates to lotion applicators for use by a person to apply lotion on a backside of the body. Even more particularly, the present invention relates to sunscreen lotion applicators having structure that facilitates use by a person working in an outdoor industrial setting to self-apply the lotion to the backside of the body.

DESCRIPTION OF THE PRIOR ART

Recent OSHA regulations concerning skin exposure to sun rays have affected the construction industry by prohibiting construction workers from working without a shirt. The regulations apparently allow workers to work without wearing a shirt if they can prove adequate alternative protection such as a sunblock lotion that screens against the dangerous UV sun rays. While the OSHA shirtless alternative is appreciated by the construction worker, the task of application of the sun screen lotion from a bottle to hard-to-reach areas, such as the upper back, by a male worker onto another male worker is not viewed as a masculine thing to do at the construction site. Typically, workers desiring to go shirtless have a spouse apply the sunblock lotion to the backside in the morning and hope that the protection lasts all day. A bottle containing the sunblock lotion is carried by the worker for application to accessible areas of the body. The backside generally goes untreated because the known lotion applicators are not suitable for rugged use by workers in an outdoor industrial setting. The desired structure is one whereby the lotion applicator can withstand rugged outdoor uses and which can be worn as an accessory on a worker's tool belt for spontaneous personal use. Representative of prior art backside applicators are devices such as taught by U.S. Design Pat. Nos. Des 265,255, Des 306,214, Des 307,490, Des 308,733, Des 333,191, Des 341,222, and Des 353,223, and Utility U.S. Pat. Nos. 2,800,673, 4,299,005, 4,896,984, 4,961,661, 5,240,339, and 5,360,111. These patents teaches a variety of ornamental handle and applicator head designs and functional aspects adapted for self-use to apply lotion to the backside, but do not teach the above desired industrial grade structure.

Thus, a need is seen to exist for a lotion applicator shaped with structure for reaching the backside of a person's body and having structure which is suitable for rugged outdoor industrial use and which can be carried on a worker's tool belt for spontaneous use in dispensing and application of sunblock lotion to a person's backside.

A need is also seen to exist for a lotion applicator as described above and which has a roller applicator valve in contact with the lotion which dispenses the lotion by roll-on action from a handle containing the lotion.

Accordingly, it is an object of the present invention to provide a lotion applicator shaped with structure for reaching the backside of a person's body and having structure which is suitable for rugged outdoor industrial use and which can be carried on a worker's tool belt for spontaneous use in dispensing and application of sunblock lotion to the person's backside.

It is also an object of the present invention to provide a lotion applicator as described above and which has a covered head member and a dispensing mechanism which dispenses different viscosity of sunscreen lotions from a handle containing the lotion.

SUMMARY OF THE INVENTION

Accordingly, the foregoing objects are accomplished by providing a sunscreen lotion applicator comprising an elongated, rugged construction, contoured, lotion container, tubular handle having a gripping end member and a flexible necked lotion applicator head member. The lotion container handle is contoured for facilitating not only the access to a person's backside for lotion application, but also for being conveniently carried and adjusted by a construction worker on a tool belt in a similar manner as other tools, such as hammers and wrenches. The contoured tubular handle includes a detachable fill cap having a rough texture for firm grasping for on/off manipulation by a construction worker wearing gloves. Similarly, the curved tubular handle includes upper and lower grip members that facilitates firm grasping for insertion and removal from a tool belt and similar firm grasping by a construction worker during its use. The handle is further provided with an elongated window for viewing the amount of lotion remaining within the handle. The applicator head member is preferably provided in the form of a ball roll-on applicator, but may be provided as a cylindrical roller, or as a replaceable porous dauber. The applicator head connects with the handle member via a bellows portion that facilitates movement that compensates the fixed contoured portion of the handle to enhance accessibility to hard to reach areas of a user's backside, and also to provide adjustment means for positioning of the applicator head for a comfortable fit while being worn on a tool belt. The head member includes a first chamber region in fluid communication with the main, lotion container handle body and a second dispensing chamber region in communication with the applicator ball, roller, or porous dauber, as provided. The two chambers are separated by an open/close mechanism which controls the flow of different viscosities of lotions into the dispensing chamber. The applicator end is provided with a chained, detachable cover member having stop means that prevents continued rolling and dispensing of unused lotion from the dispensing chamber portion during periods of non-use.

Therefore, to the accomplishments of the foregoing object, the invention consists of the foregoing features hereinafter fully described and particularly pointed out in the claims, the accompanying drawings and the following disclosure describing in detail the invention, such drawings and disclosure illustrating but one of the various ways in which the invention may be practiced.

BRIEF DESCRIPTION OF THE DRAWINGS

FIG. 1 is a side view of lotion applicator apparatus in accordance with the present invention showing a partial cutaway view of a cap covering a lotion roll-on member that is disposed on a head portion of the applicator and is coupled to a contoured heavy duty lotion container handle.

FIG. 2 shows a front view of the present invention taken along line 2—2 in FIG. 1 showing a ball roll-on applicator member provided on the head portion of the present invention.

FIG. 3*a* shows a partial front view of a cylindrical roller alternative embodiment on the head portion of the present invention.

FIG. 3*b* shows a partial front view of a dauber alternative embodiment on the head portion of the present invention.

DESCRIPTION OF THE PREFERRED EMBODIMENTS OF THE INVENTION

Figure 8:
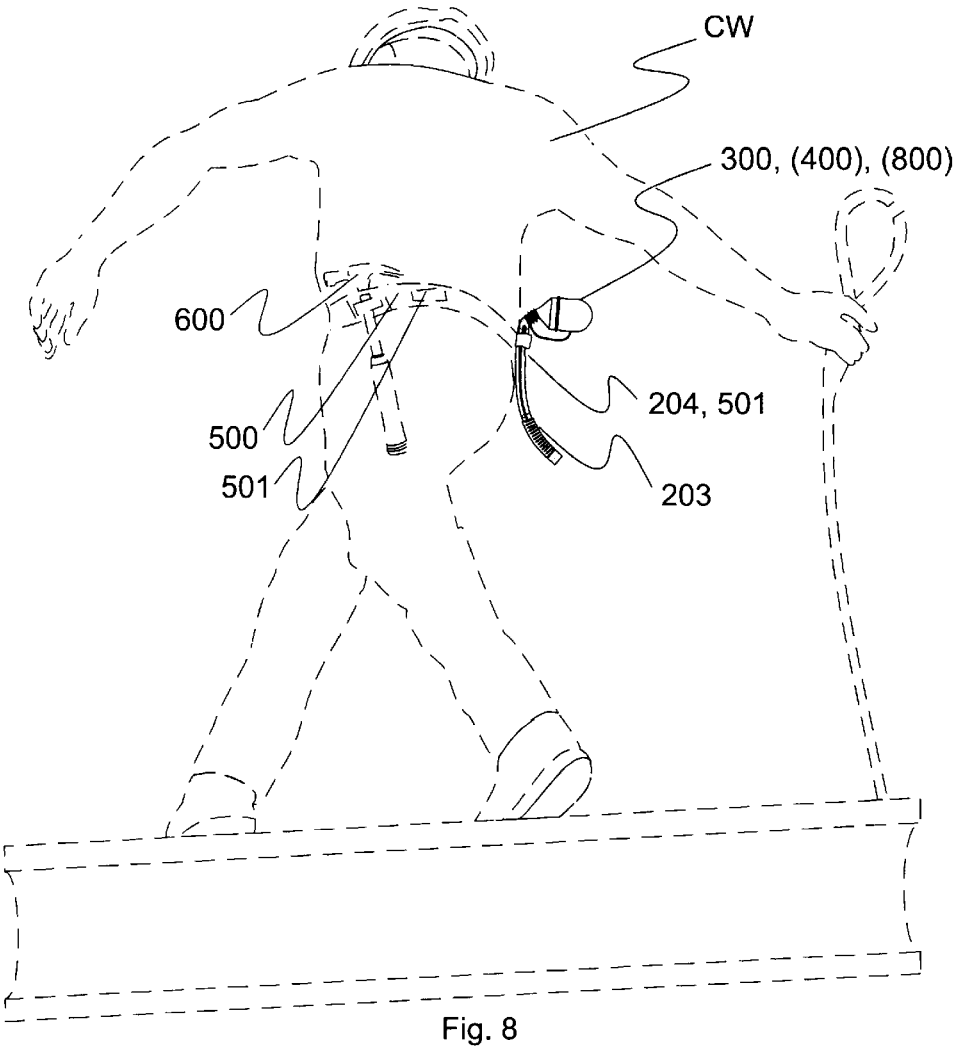
FIG. 8 shows a back view of a shirt less construction worker wearing the lotion applicator of the present invention on a tool belt.
Figure 9:
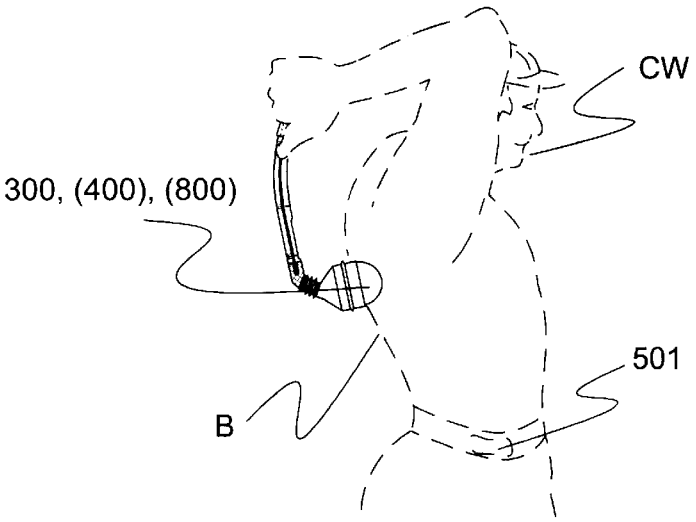
FIG. 9 shows a back side view of a construction worker utilizing the lotion applicator of the present invention.

FIG. 1 shows a personal use lotion applicator apparatus 100 in accordance with the present invention. Lotion applicator 100 comprises a geometrically shaped, preferably cylindrically shaped, elongated handle container body 200, a ball roll-on lotion applicator head member 300 and a valve member 302 interdisposed between handle container body 200 and a dispensing end of lotion applicator head member 300. Alternative head member designs include a cylindrical roller embodiment 400 and dauber embodiment 800 as shown in FIGS. 3*a* and 3*b*, respectively. Each of the embodiments 300, 400, 800 comprise a valve member 302 that controls a flow of lotion, from handle container body 200 into the particular head member 300, 400, 800, being employed, see generally FIGS. 7*a* and 7*b* for embodiments 400, 800. Handle container body 200 comprises an elongated, substantially C-shaped portion dimensioned such that lotion apparatus 100 is suitable for self-manipulation for reaching a major portion of a backside B of a person using apparatus 100, by example a shirt less construction worker CW using the apparatus 100 with applicator embodiments 300, (400), (800), as shown in FIG. 9. Additionally, handle container 200 is provided with an upper gripping element 206 that facilitates insertion and extraction of apparatus 100, and associated embodiments 300, 400, and 800, into and from a carriage location, such as belt loops 501 on a construction worker's tool belt 500, see FIG. 8. Lotion applicator 100 is further provided with a lower gripping element 202 in the form of a friction outer clad portion 202*a* having serrations 202*b* for firmly grasping apparatus 100 during use. FIG. 1 shows a carriage facilitating portion 204 that facilitates apparatus 100 being carried on tool belt 500 in a manner similar to other tools carried on a tool belt, by example, a hammer 600 supported by belt loops 501, see also FIG. 8. To enhance carrying, FIG. 1 shows carriage facilitating portion 204 formed as a notch-like, indent portion, shown using the same numeral 204, and formed at an upper portion of handle container body 200.

Still referring to FIG. 1, handle container body 200 is also provided with a graduated window opening 203 for viewing the liquid contents L, or no liquid contents NL, within the container body. Window opening 203 includes markers 203*a* that further help to indicate an approximate amount of the liquid L remaining in the container. In addition to the lower gripping element 202 that help in providing a construction worker with a tool-like feel in using apparatus 100, a fill cap member 201 is provided with a rough texture in the form of serrations 201*a*, that facilitate a firm grasp of cap 201 to remove the cap for filling the container handle 200 with a liquid, such as a sun block lotion. As discussed above, handle container body 200 comprises an elongated, substantially C-shaped portion dimensioned such that lotion apparatus 100 is suitable for self-manipulation for reaching a major portion of a backside B of a construction worker CW. As shown in FIG. 2, a length d1 in the range of 10 to 15 inches provides adequate reach to effect a comfortable application of lotion to hard to reach areas of the backside. To compensate for a fixed contour that is formed into the C-shaped portion, the container handle is provided with a flexible bellows portion 205 that flexes as indicated by arrow A1 to comfortably reach and apply lotion.

Figure 4:
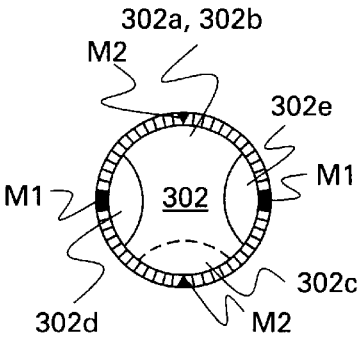
FIG. 4 shows a front view of the open/close mechanism employed in the present invention shown in a closed state.
Figure 5:
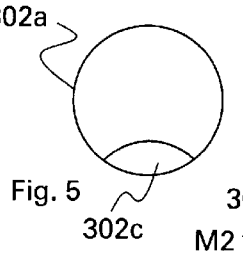
FIG. 5 shows a front view of the fixedly disposed member of the open/close mechanism illustrated in FIG. 4.
Figure 6:
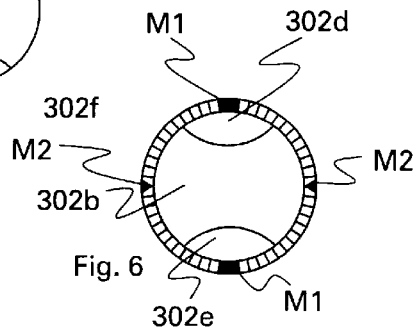
FIG. 6 shows a front view of the movably disposed member of the open/close mechanism illustrated in FIG. 4.

As discussed above, each head member embodiment 300, 400 and 800 comprises a valve member 302, by example a valve member 302 comprising a pair of discs 302*a* and 302*b*, as shown in FIGS. 5 and 6, disposed between liquid feed chamber portion 301, (401), (801) and liquid dispensing chamber portion 303, (403), (803) in a movable contacting relationship as shown in FIG. 4 to effect open and closed states of liquid from container handle 200. Preferably disc 302*a* is fixedly seated at the end of feed chamber 301, (401), (801) while disc 302*b* is movably seated overlaying disc 302*a*. Disc 302*b* is larger in diameter by virtue of a thumb operated portion 302*f* that extends outward for use by a person to rotate openings 302*d* or 302*e* of disc 302*b* over opening 302*c* of disc 302*a*. Markings M1 on portion 302*f* aid in determining an open state while markings M2 aid in determining a closed state. Marking M1 and M2 are aligned with marker 301*a*, (401*a*), (801*a*) on an outer surface of feed chamber 301, (401), (801) to achieve an open or closed state. The size of the opening can be controlled by the user depending upon the viscosity of the lotion contained within container handle 200**.

The head member of apparatus 100 is preferably a ball roll-on embodiment 300. This embodiment comprises a feed chamber portion 301, a valve member 302, a dispensing chamber 303 from which a ball 304 and associated surface 304*a* can movably contact a contained lotion for application as depicted by motion arrows A2, A3. Ball 304 is movably seated at a wipe-end portion 303*a* of dispensing chamber 303. Ball 304 is covered with a cover member 305 having stop means 505*a* that prevents continued rolling and dispensing of unused lotion from the dispensing chamber portion 303 during periods of non-use. Cover 305 is provided with groove closure means 305*b* that mates with a raised ring portion 303*b* provided proximate protrusion 302*f* of valve member 302. A retainer member in the form of a chain 700 is attached at a clip end 701 of cover member 305 and attached at ring end 702 of container handle 200.

Figure 7A:
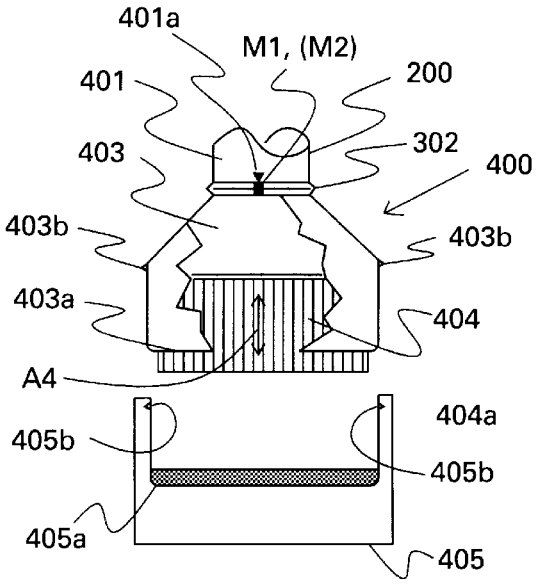
FIG. 7*a* shows a top view of the cylindrical roller alternative embodiment illustrated in FIG. 3*a*.

The head member of apparatus 100 is alternatively provided as a cylindrical roller embodiment 400 as illustrated in FIGS. 3*a* and 7*a*. This embodiment comprises a feed chamber portion 401, a valve member 302, a dispensing chamber 403 from which a cylindrical roller 404 and associated surface 404*a* can movably contact a contained lotion for application as depicted by motion arrow A4. Roller 404 is movably seated at a wipe-end portion 403*a* of dispensing chamber 403. Roller 404 is covered with a cover member 405 having stop means 405*a* that prevents continued rolling and dispensing of unused lotion from the dispensing chamber portion 403 during periods of non-use. Cover 405 is provided with groove closure means 405*b* that mates with a raised tip portion 403*b*. Cover 405 is also retained using a retainer member in the form of a chain 700.

Figure 7B:
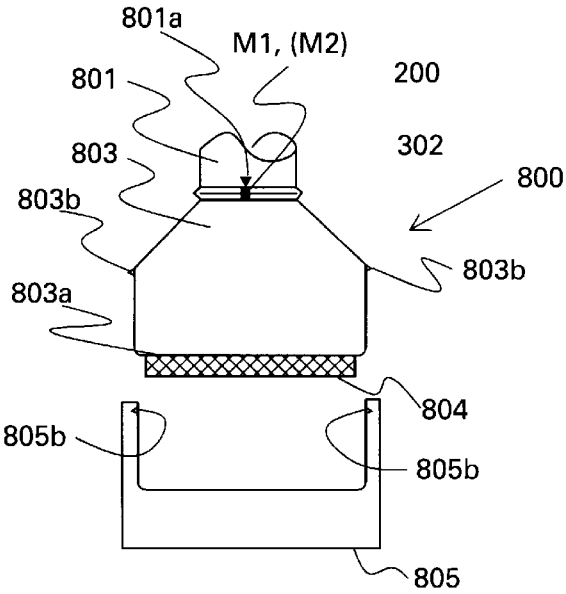
FIG. 7*b* shows a top view of the dauber alternative embodiment illustrated in FIG. 3*b*.

The head member of apparatus 100 is also alternatively provided as a dauber embodiment 800 as illustrated in FIGS. 3*b* and 7*b*. This embodiment comprises a feed chamber portion 801, a valve member 302, a dispensing chamber 803 from which a porous pad 804 can draw a contained lotion for application. Pad 804 is preferably replaceable and is removably seated at a seat portion 803*a* of dispensing chamber

803. Pad 804 is covered with a cover member 805 that prevents dispensing of unused lotion from the dispensing chamber portion 803 during periods of non-use. Cover 805 is provided with groove closure means 805*b* that mates with a raised tip portion 803*b*. Cover 805 is also retained using a retainer member in the form of a chain 700.

In use, either embodiment 300, 400, 800 has container handle 200 filled with a lotion of personal choice, by example a sun block lotion, by removing cap 201. Apparatus 100 is adapted for use by a construction worker CW by wearing on a tool belt 500 utilizing belt loops 501 and held in place by a notch 204 on container handle 200. Grip element 206 aids in inserting and removing the applicator from belt loops 501. Grip element 202 aids in manipulation of apparatus 100 during use, while bellows portion 205 aids in positioning the head applicator head member during use.

Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus.

I claim:

1. A personal use lotion applicator apparatus, said apparatus comprising:

a geometrically shaped, elongated container body, said container body comprising a contoured portion, a belt loop carriage facilitating portion that facilitates said apparatus being carried on a construction worker's tool belt in a manner similar to other tools carried on said construction worker's tool belt, and an upper gripping element that facilitates insertion and extraction of said apparatus into and from a belt loop provided on said construction worker's tool belt, and a lower gripping element for firmly grasping said apparatus during use;

a lotion applicator head member; and a valve member interdisposed between said container body and said lotion applicator head member, wherein said belt loop carriage facilitating portion comprises a notch-like indent portion formed at an upper portion of said container body, wherein said lotion applicator head member comprises a reservoir portion mechanically coupled to said valve member, a lotion dispensing mechanism mechanically coupled to said reservoir portion, a cover member for said lotion dispensing mechanism, and a retainer member attached at one end to said cover member and attached at another end to said container body, and wherein said container body comprises a handle for said apparatus and said contoured portion comprises an elongated, substantially C-shaped portion dimensioned to span a sufficient distance, such that said lotion applicator apparatus is suitable for self-manipulation for reaching a major portion of a backside of a person using said apparatus.

2. A personal use lotion applicator apparatus as described in claim 1, wherein:

said sufficient distance being in a range of ten (10) to fifteen (15) inches.

3. A personal use lotion applicator apparatus as described in claim 1, wherein:

said container body comprises a graduated window opening for viewing amount of contents within said container body; and said container body further comprises a rough textured fill cap member.

4. A personal use lotion applicator apparatus as described in claim 1, wherein:

said container body further comprises a flexible bellows portion; and a feed chamber portion in direct fluid communication with said valve member.

5. A personal use lotion applicator apparatus as described in claim 1, wherein:

said lotion dispensing mechanism mechanically comprises a ball roller.

6. A personal use lotion applicator apparatus as described in claim 1, wherein:

said lotion dispensing mechanism mechanically comprises a cylindrically shaped roller.

7. A personal use lotion applicator apparatus as described in claim 1, wherein:

said lotion dispensing mechanism mechanically comprises a porous dauber.

8. A personal use lotion applicator apparatus as described in claim 1, wherein:

said valve member comprises a first disc member having at least one opening, said first disc member being fixedly attached at an end opposite a fill end of said container body, and a second disc member also having at least one opening, said second disc member being movably attached at said end opposite said fill end of said container body in an overlay contacting relationship with said first disc member such that said at least one opening on said second disc member may be rotated about said first disc member to form an open position, consisting of a variably sized opening, and a completely closed position between said container body and said lotion applicator head member.

9. A personal use lotion applicator apparatus as described in claim 8, wherein:

said second disc member comprises an internal disc portion and an external disc portion, said external disc portion having a serrated texture to facilitate open and closed rotation and markings for aid in aligning said second disc member to an open or closed position.

10. A personal use lotion applicator apparatus, said lotion applicator apparatus comprising:

(a) a geometrically shaped, elongated handle container body, said container body comprising:

(i) a substantially C-shaped portion dimensioned such that said lotion applicator apparatus is suitable for self-manipulation for reaching a major portion of a backside of a person using said apparatus;

(ii) an upper gripping element that facilitates insertion and extraction of said apparatus into and from a belt loop provided on a construction worker's tool belt;

(iii) a lower gripping element for firmly grasping said apparatus during use;

(iv) a belt loop carriage facilitating portion that facilitates said apparatus being carried on said construction worker's tool belt loop in a manner similar to other tools carried on said construction worker's tool belt, said belt loop carriage facilitating portion comprising a notch-like indent portion formed at an upper portion of said container body;

(b) a lotion applicator head member; and (c) a valve member interdisposed between said container body and said lotion applicator head members, wherein said lotion applicator head member comprises a reservoir portion mechanically coupled to said valve member, a lotion dispensing mechanism mechanically coupled to said reservoir portion, a cover member for said lotion dispensing mechanism, and a retainer member attached at one end to said cover member and attached at another end to said container body.

11. A personal use lotion applicator apparatus as described in claim 10, wherein:

said container body further comprises a graduated window opening for viewing amount of contents within said container body, a rough textured fill cap member, a flexible bellows portion, and a feed chamber portion in direct fluid communication with said valve member.

12. A personal use lotion applicator apparatus as described in claim 10, wherein:

said lotion dispensing mechanism mechanically comprises a ball roller.

13. A personal use lotion applicator apparatus as described in claim 10, wherein:

said lotion dispensing mechanism mechanically comprises a cylindrically shaped roller.

14. A personal use lotion applicator apparatus as described in claim 10, wherein:

said lotion dispensing mechanism mechanically comprises a porous dauber.

15. A personal use lotion applicator apparatus as described in claims 10, wherein:

said valve member comprises a first disc member having at least one opening, said first disc member being fixedly attached at an end opposite a fill end of said container body, and a second disc member also having at least one opening, said second disc member being movably attached at said end opposite said fill end of said container body in an overlay contacting relationship with said first disc member such that said at least one opening on said second disc member may be rotated about said first disc member to form an open position consisting of a variably sized opening, and a completely closed position between said container body and said lotion applicator head member, said second disc member comprising an internal disc portion and an external disc portion, said external disc portion having a serrated texture to facilitate open and closed rotational manipulation, and markings for aid in aligning said second disc member to an open or closed position.

16. A personal use lotion applicator apparatus, said apparatus comprising:

(b) a geometrically shaped, elongated handle container body, said container body comprising:

(i) a substantially C-shaped portion dimensioned such that said lotion apparatus is suitable for self-manipulation for reaching a major portion of a backside of a person using said apparatus;

(ii) an upper gripping element that facilitates insertion and extraction of said apparatus into and from a belt loop provided on a construction worker's tool belt;

(iii) a lower gripping element for firmly grasping said apparatus during use;

(iv) a belt loop carriage facilitating portion that facilitates said apparatus being carried on said belt loop provided on a said construction worker's tool belt in a manner similar to other tools carried on said construction worker's tool belt, said belt loop carriage facilitating portion comprising a notch-like indent portion formed at an upper portion of said container body;

(v) a graduated window opening for viewing amount of contents within said container body;

(vi) a rough textured fill cap member, (vii) a flexible bellows portion, and (viii) a feed chamber portion in direct fluid communication with said valve member; and (a) a valve member;

(c) a lotion applicator head member, said valve member being interdisposed between said container body and said lotion applicator head member, said lotion applicator head member comprising:

(i) a reservoir portion mechanically coupled to said valve member, (ii) a lotion dispensing mechanism mechanically coupled to said reservoir portion, said lotion dispensing mechanism mechanically comprising a ball roller;

(iii) a cover member for said lotion dispensing mechanism, and (iv) a retainer member attached at one end to said cover member and attached at another end to said container body, wherein:

said valve member comprises a first disc member having at least one opening, said first disc member being fixedly attached at an end opposite a fill end of said container body, and a second disc member also having at least one opening, said second disc member being movably attached at said end opposite said fill end of said container body in an overlay contacting relationship with said first disc member such that said at least one opening on said second disc member may be rotated about said first disc member to form an open position consisting of a variably sized opening, and a completely closed position between said container body and said lotion applicator head member, said second disc member comprising an internal disc portion and an external disc portion, said external disc portion having a serrated texture to facilitate open and closed rotational manipulation, and markings for aid in aligning said second disc member to an open or closed position.

* * * * *

UNITED STATES PATENT AND TRADEMARK OFFICE

CERTIFICATE OF CORRECTION

PATENT NO. : 5,851,077

DATED : December 22,1998

INVENTOR(S) : Pamela L. Trejo

It is certified that error appears in the above-identified patent and that said Letters Patent is hereby corrected as shown below:

Column 4, line 38, delete [505a] and insert --305a--.

Signed and Sealed this

Twenty-seventh Day of July, 1999

*Attest:*

Q. TODD DICKINSON

*Attesting Officer*

*Acting Commissioner of Patents and Trademarks*